United States Patent [19]

Pickrell

[11] 4,425,836

[45] Jan. 17, 1984

[54] FLUID PRESSURE MOTOR

[75] Inventor: John W. Pickrell, Scottsdale, Ariz.

[73] Assignee: Government Innovators, Inc., Phoenix, Ariz.

[21] Appl. No.: 236,145

[22] Filed: Feb. 20, 1981

[51] Int. Cl.[3] ..... F15B 15/22

[52] U.S. Cl. ..... 91/405; 91/409

[58] Field of Search ..... 91/409, 408, 405, 407, 91/406, 404, 25, 26; 92/85 B, 158; 188/285, 287; 138/42, 43, 46

[56] References Cited

U.S. PATENT DOCUMENTS

| | | | |
|---|---|---|---|
| 3,082,746 | 3/1963 | Kerridge | 91/405 |
| 3,296,942 | 1/1967 | Nelson | 91/409 |
| 3,568,571 | 3/1971 | Hoen et al. | 91/405 |
| 4,207,802 | 6/1980 | Homuth | 91/409 |

FOREIGN PATENT DOCUMENTS

| | | | |
|---|---|---|---|
| 752329 | 7/1956 | United Kingdom | 92/158 |

*Primary Examiner*—Paul E. Maslousky
*Attorney, Agent, or Firm*—Don J. Flickinger

[57] ABSTRACT

After the piston, in a piston/cylinder type fluid pressure motor, has moved past the fluid discharge port during termination of the stroke, fluid is forced to flow through a circuitous conduit formed into the outer surface of the piston. The rate of deceleration of the piston is proportional to the length, cross-sectional area, and surface finish of the channel forming the conduit.

10 Claims, 4 Drawing Figures

FLUID PRESSURE MOTOR

FIELD OF THE INVENTION

This invention relates to fluid pressure motors.

In a further aspect, the present invention relates to fluid pressure motors of the type having a piston reciprocally disposed within a cylinder.

More particularly, the instant invention concerns improved means for cushioning the piston during the terminal portion of movement.

PRIOR ART

Motors for converting fluid pressure energy to mechanical energy are well known. Exemplary is the linear actuator type which provides rectilinear or straight-line reciprocating motion. Movement is in response to the application of pressurized fluid, usually hydraulic, to one side or the other of a reciprocal piston.

Typically, the piston resides within the bore of a cylinder having closed ends. In a double-acting device, the piston has a face on either side. A variable volume chamber is formed between each piston face and the respective end wall of the cylinder. An operating rod, for imparting movement to a selected apparatus, projects from the piston through an end wall.

Proximate either end, a fluid transfer port projects through the cylinder, communicating between the respective chamber and a potential source of pressurized fluid. Further, each port alternately functions as an input and as an exhaust. As pressurized fluid is introduced through one port, the volume of the associated chamber is progressively increased urging movement of the piston in the respective direction. Concurrently, in response to the decreasing volume of the other cylinder, fluid is discharged through the allied port. Generally, each port is spaced from the respective end of the cylinder and is substantially closed by the outer surface of the piston as it moves toward the end wall during the terminal portion of the stroke.

The piston normally travels at a relatively rapid rate with considerable momentum. Contributing to the momentum is the mass of the load secured to the free end of the operating rod. Should the piston stop abruptly, the resulting shock can severely damage the fluid pressure motor and the apparatus attached to the operating rod. It is imperative, therefore, to decelerate the piston and provide cushioning during the terminal portion of the stroke.

In recognition of the foregoing phenomenom, the prior art has offered numerous proposals. A particularly common scheme involves the employment of a movable valving member. The member is moved in a first direction in response to incoming pressurized fluid to unblock a passage communicating between the port and the respective chamber. In response to fluid pressure within the chamber during the terminal portion of the stroke after the piston has passed the discharge port, the valving member is urged in a second, opposite direction to at least partially restrict the passage.

The valving member may assume an annular configuration carried within a groove, analogous to a conventional piston ring. Other members are in the form of a semicircular insert residing within an appropriately shaped recess within the piston. A slide element, carried by the cylinder and movable over the port, is also known. Such valving members may be either free-floating or spring-biased.

The prior art has also considered the groove as a means of checking fluid flow during termination of the stroke. One form of groove, cut into the interior of the cylinder, extends between the port and the respective end wall. Grooves cut into the piston are also known. Exemplary is a configuration involving a circumferential groove located adjacent the port when the piston is at the end of the stroke. A plurality of parallel groove communicate between the circumferential groove and the face of the piston.

The use of a movable valving member materially increases the complexity of the fluid pressure motor. Initially, this is accompanied by increased manufacturing complexities and costs. Members which bear against the cylinder are subject to wear and, in turn, induce wear of the cylinder wall. Consequently, like the piston to cylinder sealing ring, require periodic maintenance. Accordingly, the use of such members is not considered to be an entirely satisfactory proposal.

Neither have prior art groove systems proven to be totally acceptable. Machining an axially extending groove into the interior surface of a cylinder is a difficult operation. Forming a plurality of axial, or nearly axial, grooves on the piston is similarly laborious. Additionally, grooves of present configuration tend to be relatively ineffective.

Ideally, the deceleration of the piston should be progressive. The distance from the port to the end of the cylinder, even in a substantially large diameter fluid pressure motor, is a fraction of an inch. Axial, or nearly axial, grooves are correspondingly, exceedingly short. Therefore, the rate of flow through the groove is relatively rapid. To further impede the fluid, in systems employing a plurality of grooves, the prior art has suggested the addition of a movable valving member.

Neither movable valving members nor grooves provide progressive deceleration of the piston. Each presents a restriction of relatively constant rate. In response to the redirecting of the fluid, from freely flowing through the port to flowing through the restriction, the piston is abruptly slowed. No further deceleration occurs during the termination of the stroke.

It would be highly advantageous, therefore, to remedy the deficiencies inherent in the prior art.

Accordingly, it is an object of the present invention to provide improvements for fluid pressure motors of the type having a cylinder and a reciprocal piston.

Another object of the invention is the provision of improved means for dampening and cushioning a hydraulic piston during the terminal portion of movement.

And another object of the invention is to provide means for decelerating a piston during termination of the stroke.

Still another object of this invention is the provision of a fluid pressure motor in which the piston is progressively decelerated as it approaches the end of the cylinder.

Yet another object of this invention is to provide decelerating and cushioning means which can be used with conventional, commercially available motors of the immediate type.

Yet still another object of the invention is the provision of relatively simple, inexpensive cushioning means.

And a further object of the instant invention is to provide deceleration means which are substantially maintenance free.

Still a further object of the immediate invention is the provision of cushioning means which does not encumber the cylinder nor the piston with extraneous additions.

Yet a further object of the invention is to provide decelerating means which are suitable for newly manufactured motors or as retrofit for pre-existing units.

And yet a further object of the invention is the provision of means according to the above in which the degree of cushioning and the rate of deceleration can be established in accordance with a predetermined value.

SUMMARY OF THE INVENTION

Briefly, to achieve the desired objects of the instant invention, in accordance with a preferred embodiment thereof, provided is a circuitous conduit carried by the piston for the transfer of fluid from the decreasing volume chamber to the port after the port has been substantially closed by the piston. The circuitous conduit extends from the face of the piston for a distance substantially equal to the distance of the port from the end of the cylinder. In accordance with a preferred embodiment of the invention, the conduit is in the form of a channel formed into the outer surface of the piston.

In accordance with a further embodiment of the invention, the channel describes a helix about the circumference of the piston. The pitch of the helix is such that at least a portion of the channel is in constant communication with the port during the terminal portion of the stroke. In accordance with a more specific embodiment of the invention, the channel is generally V-shaped and extends along the piston a distance corresponding to the distance between the end wall of the cylinder and the axis of the port. An annular groove may be formed in the outer surface of the piston at the end of the channel.

BRIEF DESCRIPTION OF THE DRAWINGS

The foregoing and further and more specific objects and advantages of the instant invention will become readily apparent to those skilled in the art from the following detailed description of a preferred embodiment thereof, taken in conjunction with the drawings, in which.

DESCRIPTION OF THE PREFERRED EMBODIMENTS

Figure 1:
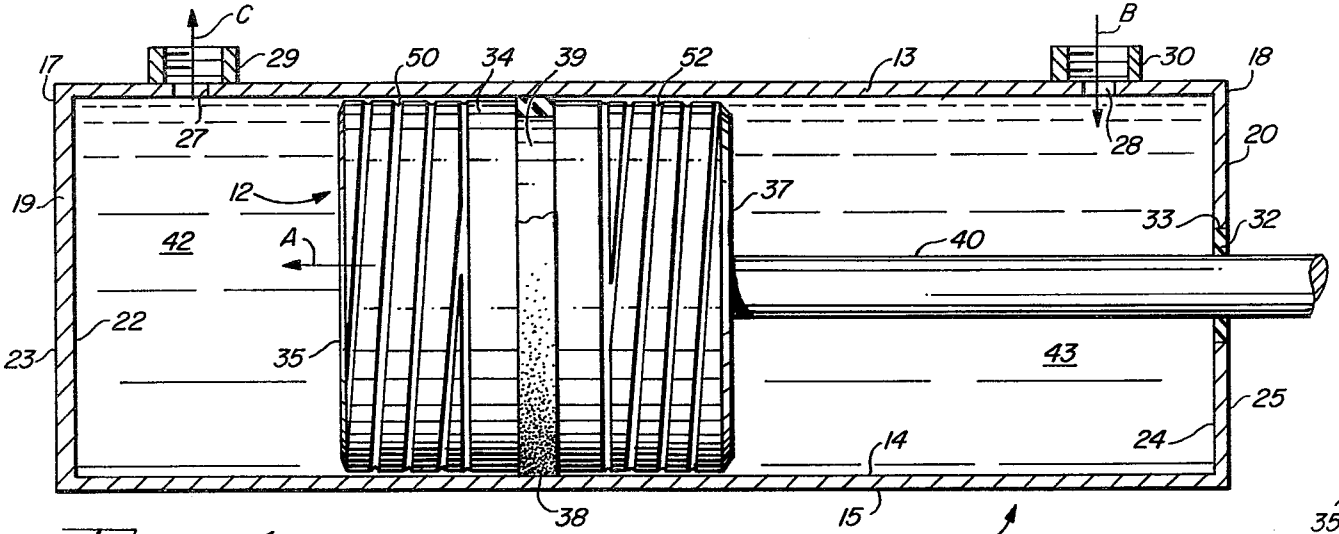
FIG. 1 is a cross-sectional elevational view taken along the longitudinal axis of a typical, conventional fluid pressure motor of the cylinder piston type and embodying the principles of the instant invention.

Turning now to the drawings in which like reference characters indicate corresponding elements throughout the several views, attention is first directed to FIG. 1 which illustrates a typical double acting fluid pressure motor having conventional cylinder and piston generally designated by the reference characters 10 and 12, respectively. Cylinder 10, which forms the outer housing of the motor, includes cylindrical sidewall 13 having inner surface 14, outer surface 15, first end 17 and second end 18. Ends 17 and 18 are closed by first and second end walls 19 and 20 respectively. End wall 19 includes inner surface 22 and outer surface 23. Similarly, second end wall 20 includes inner surface 24 and outer surface 25.

First fluid transfer port 27 extends through sidewall 13 proximate first end 19. Second fluid transfer port 28 extends through sidewall 13 proximate second end 20. First coupling 29 and second coupling 30 respectively associated with first fluid transfer port 27 and second fluid transfer port 28, provide for attachment of fluid supply lines communicating with a source of pressurized fluid, such as a pump, as will be readily understood by those skilled in the art. Annular seal 32 is held, in accordance with conventional means and methods, in aperture 33 extending through end wall 20.

Piston 12, having outer cylindrical surface 34, first face 35 and second face 37, is slidably disposed within cylinder 10. Being double-acting, piston 12 further includes annular seal 38 carried in groove 39 at a location intermediate faces 35 and 37 to prohibit the transfer of hydraulic fluid from one side thereof to the other. Operating rod 40, affixed at one end thereof to piston 12, extends through, in seating engagement, seal 32. In accordance with conventional practice, a load to be acted upon or moved is affixed to the free end of operating rod 40.

A pair of variable volume chambers reside within cylinder 10. First chamber 42 is formed between face 35 of piston 12 and surface 22 of end wall 19. Second chamber 43 is defined between face 37 of piston 12 and surface 24 of end wall 20. Ports 27 and 28 communicate between a source of pressurized fluid and the respective chambers 42 and 43. Each port alternately functions as an intake and as an exhaust when considered with the direction of movement of piston 12.

For purposes of illustration, it is assumed that piston 12 is moving in the direction of arrowed line A. Pressurized fluid is being introduced into chamber 43 through port 28 in the direction of arrowed line B. As a result thereof, the volume of chamber 43 is expanding and force is applied to face 37 urging piston 12 to move in the direction of arrowed line A. Correspondingly, the volume of chamber 42 is progressively decreasing as fluid is discharged in the direction of arrowed line C through port 27.

Movement of piston 12 continues until face 35 substantially abuts inner surface 22 of end wall 19. This represents termination of the stroke in the direction of arrowed line A. It is noted that during the terminal portion of movement, face 35 has passed port 27 which is then substantially closed by outer cylindrical surface 34. The relaxation of pressure through port 28 and the introduction of pressurized fluid through port 27 urges movement of piston 12 in a direction counter to arrowed line A until face 37 substantially abuts inner surface 24 of end wall 20. The foregoing description will be readily apparent to those having regard for the art.

Figure 2:
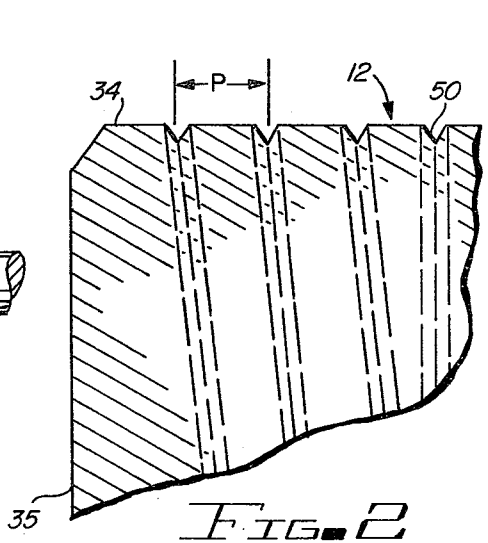
FIG. 2 is a fragmentary elevation view of a portion of the piston seen in FIG. 1.
Figure 4:
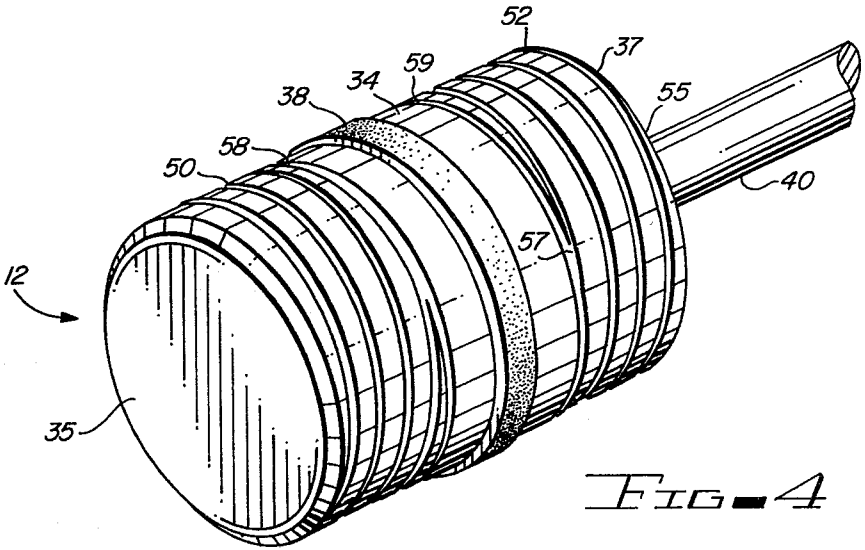
FIG. 4 is a perspective view of the piston illustrated in FIG. 1.
Figure 3:
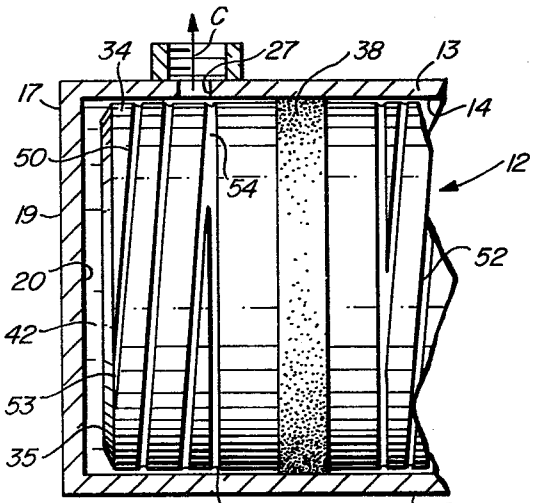
FIG. 3 is a vertical sectional view generally corresponding to the view of FIG. 1 as it would appear when the piston has nearly reached the termination of its stroke.

The instant invention contemplates a circuitous conduit for the transfer of fluid from chamber 42 to transfer port 27 and from chamber 43 to port 28 after the respective ports have been substantially closed by sidewall 34 of piston 12. With particular reference to FIG. 4, there is seen a first circuitous conduit 50 residing between face 35 and seal 38 and a second circuitous conduit 52 residing between face 37 and seal 38. In accordance with an immediately preferred embodiment of the invention, each circuitous conduit is in the form of a helical channel formed into the outer surface 34 of piston 12. For purposes of illustration, as seen in FIG. 2, each channel is generally V-shaped in cross-section, having the wider portion adjacent surface 34 and converging to an inwardly directed apex.

The channel forming conduit 50 extends between a first end 53, open at face 35, and a second end 54 which is spaced from face 35 a distance corresponding to the distance between surface 22 of end wall 19 and the longitudinal axis of port 27. Similarly, the channel forming second circuitous conduit 52 extends between a first end 55, open at face 37, and a second end 57 which is spaced from face 37 a distance corresponding to the distance from inner surface 24 of end wall 20 from the axis of port 28. Annular groove 58 is formed into the outer surface 34 of piston 12 at end 58 of conduit 50. A similar annular groove 59 is formed into the outer surface 34 of piston 12 at second end 57 of conduit 52. Preferably the pitch of the helix described by either conduit 50 or 52 corresponds, that is has a similar dimension, to the diameter of the port. For reference, the pitch is designated by the letter P in FIG. 2. A pitch thus chosen, insures that the channel is in constant communication with the respective port.

During operation, as piston 12 moves in the direction of arrowed line A as viewed in FIG. 1, fluid within decreasing volume chamber 42 is freely discharged through port 27. As face 35 passes port 27, the port is substantially closed by surface 34. In response to continued application of pressure to surface 37 and movement of piston 12 in the direction of arrowed line A, fluid enters conduit 50 through first end 53. The flow of fluid from chamber 42 through port 27 is thereby checked resulting in deceleration of piston 12. Initially, the fluid need flow only a portion of a single revolution in order to reach port 27. As piston 12 continues to move, the flow of the fluid through conduit 50 is progressively lengthened in order to reach port 27. The progressively increasing length of flow of the fluid and the proportionally increasing losses to friction progressively curtails the flow of fluid and, correspondingly, progressively decelerates the rate of travel of piston 12.

Utilizing the foregoing teaching, the rate of deceleration of a piston in a fluid pressure motor of the instant type can be predeterminably varied in accordance with various modifications of the circuitous conduit. Satisfactory results have been achieved, in a fluid pressure motor having a bore diameter of 2.5 inches, by a conduit having a 0.050 inch deep 60° V-groove formed as a uniform helix. The lead of the subject helix is 0.25 inches which corresponds to a standard port diameter for motors of this size. The surface finish of the groove is approximately 200 microinches.

The rate of flow of fluid through the circuitous path, and correspondingly the rate of deceleration of the piston, is proportional to the length, surface finish and cross-sectional area of the channel. A helix of lesser pitch will, for example, result in more rapid deceleration. Similarly, the rate of deceleration is increased as the cross-sectional area of the channel decreases. For a relatively slow rate of deceleration, the cross-sectional area can be increased either by increasing the width and depth of the V or forming the channel in other cross-sectional shapes, such as square. Greater fluid flow can also be accommodated by the use of a multiple lead helix. Frictional resistance to the flow of fluid through the channel can further be increased or decreased by a rougher or smoother, respectively, surface finish.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described and disclosed the present invention and the alternately preferred embodiments thereof, in such clear and concise terms as to enable those skilled in the art to understand and practice the same, the invention claimed is:

1. In a fluid pressure motor including a cylinder having a bore and an end wall, a piston reciprocally movable within said cylinder and having a face opposing said end wall and an outer surface, a variable volume chamber defined within said bore between the end wall of said cylinder and the face of said piston, and a port in said cylinder for the transfer of said fluid to and from said chamber, the outer surface of said piston effectively closing said port during the terminal portion of movement of said piston in a direction toward the end wall of said cylinder, improvements therein for regulating the transfer of said fluid between said chamber and said port and for decelerating and cushioning said piston during said terminal portion of movement, said improvements comprising:

a channel formed into the outer surface of said piston for the transfer of said fluid from said chamber to said port, said channel forming a helix about said piston having a pitch such that at least a portion of said channel is in constant communication with said port during the terminal portion of movement of said piston.

2. The improvements of claim 1, wherein said channel includes:

a. an open first end adjacent the face of said piston; and b. a second end spaced from the face of said piston.

3. The improvements of claim 2, wherein the decelerating of said piston is at a rate which is proportional to the length of said channel.

4. The improvements of claim 2, wherein the decelerating of said piston is at a rate which is proportional to the cross-sectional area of said channel.

5. The improvements of claim 2, wherein the decelerating of said piston is at a rate which is proportional to the surface finish of said channel.

6. The improvements of claim 2, wherein the pitch of said helix corresponds to the diameter of said port.

7. The improvements of claim 2, wherein said channel has a cross-sectional of less area than the area of the cross-section of said port.

8. The improvements of claim 2, wherein said channel is generally V-shaped, having the wider portion thereof adjacent the surface of said piston.

9. The improvements of claim 2, wherein the second end of said channel is spaced from the face of said piston a distance corresponding to the distance between the end wall of said cylinder and the axis of said port.

10. The improvements of claim 9, further including an annular groove formed in the outer surface of said piston and communicating with the second end of said channel.

* * * * *